US011091991B1

(12) United States Patent
Mehrvand et al.

(10) Patent No.: US 11,091,991 B1
(45) Date of Patent: Aug. 17, 2021

(54) SYSTEM AND METHOD FOR PULSED ELECTRICAL RESERVOIR STIMULATION

(71) Applicant: Eden GeoPower Inc., Somerville, MA (US)

(72) Inventors: Mehrdad Mehrvand, Somerville, MA (US); Ildar Akhmadullin, Baton Rouge, LA (US); Ammar Alali, Cambridge, MA (US); Paris Smalls, Boston, MA (US)

(73) Assignee: Eden GeoPower Inc., Somerville, MA (US)

( * ) Notice: Subject to any disclaimer, the term of this patent is extended or adjusted under 35 U.S.C. 154(b) by 0 days.

(21) Appl. No.: 16/424,428

(22) Filed: May 28, 2019

Related U.S. Application Data

(60) Provisional application No. 62/676,903, filed on May 25, 2018.

(51) Int. Cl.

| | |
|---|---|
| ***E21B 43/24*** | (2006.01) |
| ***E21B 49/00*** | (2006.01) |
| ***E21B 47/10*** | (2012.01) |

(52) U.S. Cl.
CPC ..... *E21B 43/2401* (2013.01); *E21B 43/2405* (2013.01); *E21B 47/10* (2013.01); *E21B 49/00* (2013.01)

(58) Field of Classification Search
CPC ..... E21B 43/2401; E21B 43/2405
(Continued)

(56) References Cited

U.S. PATENT DOCUMENTS

| | | | |
|---|---|---|---|
| 1,784,214 | A | 12/1930 | Workman |
| 2,799,641 | A | 7/1957 | Bell |

(Continued)

OTHER PUBLICATIONS

Bera et al., Status of electromagnetic heating for enhanced heavy oil/bitumen recovery and future propects: A review, Applied Energy 151, 2015, pp. 206-226, wwww.elsevier.com/locate/apenergy.

(Continued)

*Primary Examiner* — Zakiya W Bates
*Assistant Examiner* — Ashish K Varma
(74) *Attorney, Agent, or Firm* — Loginov & Associates, PLLC; William A. Loginov

(57) ABSTRACT

This invention provides a novel system and method for Electrical Reservoir Stimulation (ERS) that increases reservoir permeability for petroleum and geothermal applications without requiring pumping of material into the subsurface. This system and method can provide an inexpensive, reliable and more-environmentally friendly increase in reservoir productivity by releasing hydrocarbons from traps and captives, increasing fluid mobility due to viscosity reduction from electrical heating of the reservoir (extremely important for the extraction of highly viscous hydrocarbons), and providing increased reservoir permeability in the direction of interest from the vibrational removal of particles within sediment pores and initiating micro-fractures. The ERS system and method can also be applied in non-petroleum producing applications, such as for use in Enhanced Geothermal Systems (EGS), and generally avoids pumping high-pH chemicals and proppant material into the subsurface, a problem that has generally challenged operators in the geothermal and petroleum industries.

19 Claims, 6 Drawing Sheets

(58) Field of Classification Search
USPC ..... 166/248
See application file for complete search history.

(56) References Cited

U.S. PATENT DOCUMENTS

| | | | | |
|---|---|---|---|---|
| 3,211,220 | A | 10/1965 | Sarapuu | |
| 4,084,638 | A * | 4/1978 | Whiting | E21B 43/003 166/248 |
| 9,243,487 | B2 | 1/2016 | Geilikman | |
| 9,719,908 | B1 | 8/2017 | Bauer | |
| 9,726,000 | B2 | 8/2017 | Owens | |
| 9,890,627 | B2 | 2/2018 | Kasevich | |
| 9,988,888 | B2 | 6/2018 | Rey-Bethbeder | |
| 10,280,723 | B2 | 5/2019 | Ageev | |
| 2010/0272515 | A1 | 10/2010 | Curlett | |
| 2012/0152570 | A1* | 6/2012 | Thomas | E21B 43/16 166/400 |
| 2014/0069642 | A1 | 3/2014 | Frank | |

OTHER PUBLICATIONS

Harvey et al., Selective electric reservoir heating, Enhanced Recovery, Technology, Jul.-Sep. 1979, Montreal, The Journal of Canadian Petroleum, pp. 47-57.

Chilingar et al., "Electrobioremediation of Soils Contaminated with Hydrocarbons and Metals: Progess Report," Energy Sources, 19:2, 129-146, DOI: 10.1080/00908319708908838.

* cited by examiner

SYSTEM AND METHOD FOR PULSED ELECTRICAL RESERVOIR STIMULATION

RELATED APPLICATION

This application claims the benefit of U.S. Provisional Application Ser. No. 62/676,903, entitled SYSTEM AND METHOD FOR LOW-FREQUENCY ELECTRICAL TREATMENT OF PETROLEUM-BEARING FORMATIONS, filed May 25, 2018, the teachings of which are expressly incorporated herein by reference.

FIELD OF THE INVENTION

This invention relates to mainly petroleum-producing wells, and more particularly to systems and methods for enhancing production of petroleum-bearing formations accessed by such wells, though it can also be used in geothermal and water wells.

BACKGROUND OF THE INVENTION

All geothermal or petroleum production well systems require some degree of permeability to allow geo-fluid flow in the subsurface. Permeability is related to flow rate, heat source, petroleum recovery, and volume of production available from a given resource. Hence, permeability plays an important role in the economics of any given petroleum or geothermal reservoir. Several techniques were developed in the petroleum and geothermal industries in order to improve the economic viability of a resource by increasing the reservoir's geo-fluid flow and reducing the pressure drop in the reservoir. Acid injection, or acidizing, and hydraulic fracturing, are two main techniques predominantly in use today to increase permeability. These current techniques typically require pumping of a mix of water, proppant, and hazardous chemicals into the subsurface, and some states and/or other governmental authorities have promulgated rules and statutes to limit the application of such techniques and chemicals due to environmental concerns.

By way of background, acid treatment and hydraulic fracturing of the reservoir are the main techniques used to increase permeability in today's market. These methods are related to Darcy's equation, which shows the relationship between geo-fluid production rate q and pressure differences between the reservoir and the well ($P_{res.}-P_{wfp.}$):

$$q=(2\pi kh/s\mu B)*(P_{res.}-P_{wfp.})$$

where, k is the permeability; h is the reservoir thickness; B is the formation volume factor; s is the skin factor; and μ is the fluid viscosity.

Acidizing technology has advanced throughout the years, but the basic principle remains the same. In this technique, chemical stimulants, primarily hydrochloric and hydrofluoric acids at highly diluted concentrations, between 1 and 15%, injected into the reservoir rock create wormholes as sediments dissolve. This leads to a reduction in reservoir impedance and a boost in reservoir fluid flow rate. Since a corrosion inhibitor was developed to protect wells during application, acidizing techniques have experienced an increase in implementation of up to 400%. However, at high temperatures and in highly consolidated formations, acid penetration is limited, resulting in short conductive flow paths. Additionally, it is not possible to collect back all the injected treatment fluids, and thus, some of the acid will remain in the formation after the treatment is completed. Undissolved particles may build up in the well, resulting in a reduction in production flow. Acidizing remains less regulated than other techniques, though several states have proposed legislation and regulations.

Hydraulic fracturing is commonly used, and creates long, open, conductive channels as fluids are pumped into the reservoir. This chemical mixture of water and a proppant (e.g. sand) is used to prevent cracks from closing after the pressure is released in the reservoir. In some instances, gels are used when the low viscosity of water makes it difficult for proppant transport. Gel residues are prone to stay in the formation and cause minerals precipitation leading to sand production in the well. While hydraulic fracturing is economically less costly than acidization, this technique is commonly associated with an increase in seismic activity near the wellbore region, rendering it disadvantageous and controversial in certain instances.

The effort required to treat reservoirs with acidized water, fracture sand, as well as the operation and maintenance challenges and the costs of electricity in powering associated fluid pumps, renders current techniques to increase reservoir permeability environmentally hazardous, expensive, and time-consuming. A more effective, environmentally friendly and efficient technique to increase the rock permeability of reservoirs is highly desirable.

SUMMARY OF THE INVENTION

This invention overcomes disadvantages of the prior art by providing a novel system and method for Electrical Reservoir Stimulation (ERS) that increases reservoir permeability for petroleum and geothermal applications without requiring pumping of material into the subsurface. This system and method can provide an inexpensive, reliable and environmentally friendly enhancement in reservoir productivity by releasing hydrocarbons from traps and captives, increasing fluid mobility due to viscosity reduction from electrical heating of the reservoir (extremely important for the extraction of highly viscous hydrocarbons), and providing increased reservoir permeability in the direction of interest from the vibrational removal of particles within sediment pores. The ERS system and method can also be applied in non-petroleum producing applications, such as for use in Enhanced Geothermal Systems (EGS), which affords increased commercialization potential of these reservoirs. Additionally, the system and method herein avoid pumping hazardous chemicals and proppant material into the subsurface, a problem that has generally challenged operators in the geothermal and petroleum industries. The illustrative system and method more generally provide an equivalent permeability increase to the reservoir at a rate that is less costly than current methods, while also leaving a smaller environmental footprint.

In an illustrative embodiment, a system and method for increasing permeability of a subsurface reservoir in the presence of at least two adjacent wells that extend into the reservoir is provided. A high voltage pulsed power system is interconnected to each of the at least two adjacent wells each electrically connected to the reservoir. A controller modulates at least one of the pulse width, repetition rate, and voltage of the system or a combination of them, and a fluid source injects a conductive fluid (under pressure) into at least one of the two adjacent wells, so as to migrate into the reservoir in association with application of the current and discharged energy. Illustratively, at least one of the pulsed power systems and the fluid source are each connected to a respective well head that serves each of the two (or more) wells. The pulsed power system and the fluid source can be carried to the reservoir and within completion of each of the at least two wells. Also, the discharged electrical energy can be provided in an insulated cable that extends into the well and includes an exposed conductor (e.g. a conductive rod of appropriate length, thickness and material) adjacent to the region of the reservoir. The controller can be operatively connected to a flow sensor that determines changes in permeability at least, in part, based upon a change in flow of fluid from the fluid source. The fluid source typically delivers at least one of pressurized water and steam. In an alternate embodiment, the pulsed power system can be operatively connected so as to (directly) energize at least a portion of a (i.e. conductive) casing of at least one of the two adjacent wells. Illustratively, the controller is operated so that the voltage, pulse duration and repetition rate are varied based upon at least one of the distance between the at least two wells. The pulse width can be between approximately 10 microseconds and 10 seconds. The pulse repetition rate can be approximately between 1 and 1000 kHz. The voltage can be between approximately 50 kV and 500 kV. In embodiments, the controller is configured to adjust the parameters based upon a natural resonant frequency and properties of rock formation in the reservoir. This causes the treatment to, at least one of, (a) generate cracks and fractures in the rock and (b) dislodge particles from the rock. Other than increasing electrically conductivity of the reservoir, as such injecting of fluid washes out the particles under pressure. In this method, the voltage, pulse energy, and pulse width can be set between approximately 50 kV-500 kV, 5 kJ-500 kJ, 10 μs-10 s, respectively, depending on the reservoir and wells geometry and properties.

BRIEF DESCRIPTION OF THE DRAWINGS

The invention description below refers to the accompanying drawings, of which.

DETAILED DESCRIPTION

I. System and Method Overview

Figure 1:
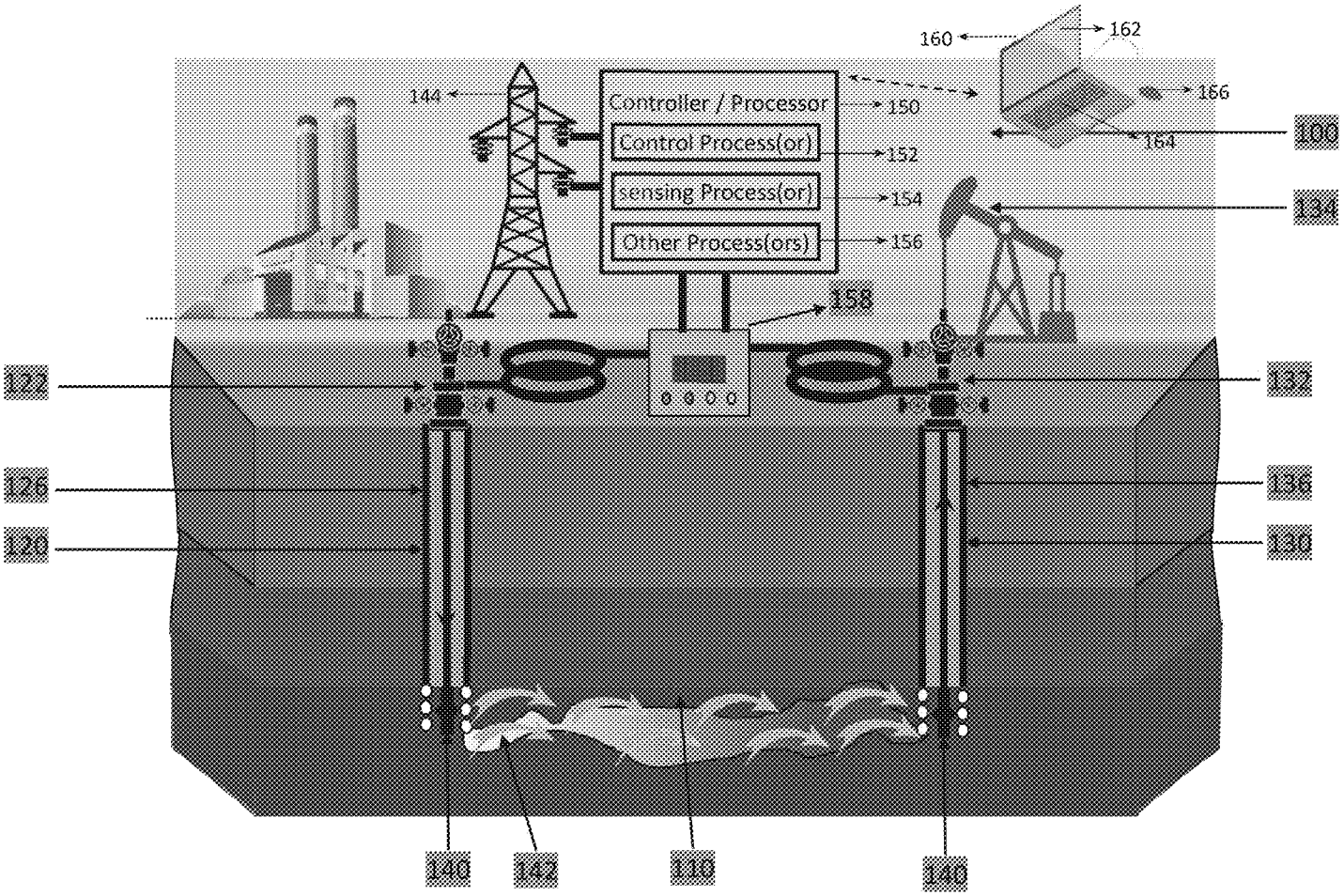
FIG. 1 is a diagram showing a pair of wells with electrodes in them in an adjacent arrangement each connected to a pulsed power system connected to a power source for performing Electrical Reservoir Stimulation (ERS) of a common reservoir therebetween, to increase permeability thereof, according to an illustrative embodiment.

FIG. 1 depicts a generalized arrangement 100 for performing Electrical Reservoir Stimulation (ERS) within a subsurface reservoir 110 between each of a plurality of drilled wells 120 and 130. The ERS can include low-frequency electrical treatment and/or pulsed-power treatment, described more fully below. The depicted wells are petroleum-producing units (e.g. gas and/or oil), that tap a reservoir that can contain, petroleum mixed with ground water (fresh or bine). Each well 120, 130 includes a respective head assembly 122, 132 that can be arranged to include (e.g. a pump mechanism 134) along with various values and connections that access the well's completion (i.e. the particular structures residing within the casing 126, 136 that facilitate petroleum production). At the depth of the reservoir 110, each casing 126, 136 can include perforations, as shown to allow fluid communication between the well and the reservoir. By way of non-limiting example, the reservoir can be located at a depth of approximately 2,000 to 10,000 ft. In pulsed-power treatment embodiments, the distance between the adjacent wells can be approximately 50 to 1500 ft. Other depths and distances are expressly contemplated.

As described above, the reservoir's permeability is a primary variable in the rate and degree of petroleum production—or in the case of a geothermal well, the recharge rate of circulated geo-fluid (e.g. water, brine, petroleum-water/brine mixtures, etc.). According to an embodiment, the illustrative system and method employs electricity, provided by the depicted, exemplary power distribution source 144, to increase permeability in the space of the reservoir 110 between wells 120, 130. The electrical connection can be made via each respective well head assembly (also known as a "Christmas tree") 122, 132 using appropriate wires and conduits that extend within the well and/or energize the casing and/or completion (via conduction of its metallic components). In general, the electrodes (e.g. a metallic rod of a given length) used to energize the reservoir are localized to the depth containing the reservoir and the leading portion of the conductor is an insulated cable. Energizing some or all of the actual casing can be hazardous to personnel and equipment on the surface except in the case of relatively dry surface conditions—as any surface moisture may conduct the current if the upper regions of the well are energized. By localizing the current source at a sufficient depth, the risk of current flowing to the surface in any significant quantity is mitigated. Hence, as shown, the localized current (arrows 142) flows between the wells 120, 130 within the reservoir 110. The current causes physical changes to occur within the matrix of sand, clay, rock, and other compounds, which compose the solid material of the reservoir in a manner that increases permeability—as described further below.

As described further below, appropriate controllers 150 are interconnected to the current source(s) that can include a pulsed power system 158 and/or low-frequency electrical treatment system, and manipulated using a processor 152. The processor can also interconnect with various sensors including current and voltage probes, and temperature, pressure, and flow sensors, and with sensor processor 154, which can be located within the well(s) or in line with the power system to measure flow of current between wells, voltage and/or other parameters—such as flow rate of completion fluid. These and other processes(ors) 156 can be instantiated within a standalone processing arrangement—such as an FPGA, and/or can be connected via interfaces with a general purpose computing environment 160. Such can include a PC, server, laptop, tablet, smartphone or other computing device having an interface—for example a display/touch-screen 162, keyboard 164 and/or mouse 166. Appropriate wired and/or wireless networking links can also be provided as appropriate, and in accordance with ordinary skill. While not shown, fluid (e.g. steam, cold water, or hot water, etc.) can be injected via each respective well head 122, 132 as part of the illustrative ERS process to assist in generating increased permeability in the reservoir.

II. Theories of Operation

Electro-Enhanced Oil Recovery (EOR) using DC was first proposed by Workman as a suitable candidate for EOR (Workman 1930, Bruninga 1957; Sarapuu 1957). Electromagnetic (induction) heating has been investigated and proposed as a potential candidate for near wellbore heating (George et al. 1997). This method has some advantages over acidization and hydrofracking techniques, including the capacity to penetrate deeper, and user control over the area in which energy is applied. These techniques, especially microwave heating, can also be applied to the shallow reservoirs which are not suitable for chemical or gas injection processes. The method is not popular because of its propensity for non-uniform heating, in which most of the input energy is concentrated near the well bore region, the need for brine salinity at a given level, corrosion of equipment (via electrolysis induced by the method). Also, microwaves only travel in line of sight, and presence of any obstacle in between the source and target may attenuate them, resulting in energy loss.

Conversely, the uniqueness of the ERS of the present embodiment arises, in part, from the expectation that an alternating current and/or a pulsed energy is more efficient in increasing rock permeability first due to the oscillatory nature of the signal and second due to better control over effectiveness of the released energy as a function of pulse characteristics such as amplitude, width, frequency, and repetition rate. Additionally, applying an alternating current and/or a pulsed energy can be less costly and faster compared to direct current applications. Low frequencies can be utilized to penetrate deeper into the reservoir than higher frequency methods. More particularly, the current frequency can be used to control the distance within the reservoir that is treated, and the amount of time needed to perform the treatment.

The nature of the heating using the ERS method differs from prior art techniques in that, instead of continuously applying a current through the reservoir for a long time, it is contemplated that impulse-like discharges of the electric current energy with high voltage potentials between the wells can be employed. In this case, high density energy can pierce the rock/sediment formation and quickly heat the reservoir up to very high temperatures. In the case of saline brine reservoirs, the method is constrained by the boiling point of the geo-fluid at the reservoir pressure-temperature conditions, which can be resolved by adding saline brine. The Archie and Humble's relation models how far the heating effect can extend into the reservoir:

$$R=R_w/\varphi^{2.15}S_w^{\ 2}$$

Where, R is the electric conductivity, $R_w$ is the water brine resistivity, $\varphi$ is the porosity, and $S_w$ is water saturation.

One limitation of these ERS methods is that the amount of heat dissipated is reduced as the quantity of water decreases. One suggestion is to use water injection along with an electrical treatment method. If water temperature is sufficiently lower than the reservoir, quenching may cause thermal stresses to initiate fractures in the direction of heating.

In the case of shale or EGS reservoirs, the governing factor for the thermal energy release would be electrical resistivity of the formation rock. Heating of the formation is expected to initiate the rock alteration processes associated with permeability enhancement. Together with a water flooding technique, either fracturing or soft mineral/clay washout or both will take place.

III. ERS Process

By way of background, publications describing the state of the art in EOR and EGS include U.S. Published Patent Application No. 2012/0152570, entitled SYSTEM AND METHOD FOR ENHANCING OIL RECOVERY FROM A SUBTERRANEAN RESERVOIR, No. 2010/272515, entitled METHOD OF DEVELOPING AND PRODUCING DEEP GEOTHERMAL RESERVOIRS, and No 2014/0069642, entitled ENHANCED OIL RECOVERY SYSTEM AND A METHOD FOR OPERATING AN UNDERGROUND OIL RESERVOIR. These described methods either rely on the use of proponents or have been developed to increase the economic potential of the reservoir prior to drilling. Conversely, the illustrative low frequency and/or pulsed power ERS systems and methods herein are adapted to be implemented in marginal wells to increase permeability, without (free of) the need to inject a mixture of water, acids, and proppants into the subsurface. ExxonMobil started treating reservoirs for steam production in 2010, but this method is primarily used to increase productivity in heavy oil fields by heating the reservoir and making the fluid flow less viscous. The illustrative ERS systems and methods herein is provided to increase permeability by both heating the reservoir rock to melt/loosen it, and by the vibrational release of sediment within the pore spaces of the reservoir. This novel functionality and result is a significant distinction from prior systems and methods described above. Similarly, existing permeability enhancement techniques are not particularly effective on tight reservoirs and shale due to the elastic nature of these rocks. The illustrative ERS system and method can advantageously increase permeability, while reducing cost and environmental effects to accomplish this in such reservoirs.

Note that the permeability of a rock depends on several parameters, including pore size. Due to thermal expansion, the clay layer located in the inner side of the pores will be removed by water flush under the illustrative pulsed electrical stimulation and/or low-frequency electrical treatment ERS procedure, which will lead to an increase in permeability. This effect is caused by dynamic resistive oscillations matching rock particles, fluid particles, and source oscillations during treatment. The controller 150 can be used to optimize these parameters based upon feedback from various sensors and sensing processes(ors). In various embodiments, the controller can adjust parameters such as current frequency, pulse width, pulse repetition rate, and voltage. The controller can adjust the pulse width in a range between approximately 10 microseconds and 10 seconds, can adjust the pulse repetition rate in a range between approximately 1 and approximately 100 KhZ, and/or can adjust the voltage in a range between approximately 50 kV and 500 kV. In regard to low-frequency electrical treatment, it is recognized that when the AC electrical current at a given frequency is applied to the reservoir, the associated rock structure fluctuates and heats up. In regard to pulsed electrical stimulation, it is also recognized that when the pulsed electric discharge at a given repetition rate is applied to the reservoir, the associated rock structure fluctuates and heats up. When the rock's natural frequency and electric current frequency substantially match, then a resonance effect can occur. The resonance drives vibrations in the rock so that it develops cracks and fractures and/or releases clay minerals. Clay minerals and the original rock, sandstone, for example, possess different/discrete densities and natural frequencies from each other. Resulting clay precipitations can be washed out by geo-fluid production. Heating of the reservoir to a relatively high temperature can also occur under the electric stimulation. The effect accelerates rock decay which occurs over a longer time in nature. This heating effect thereby causes softening of the rock and an associated increase in its permeability and porosity.

Previous workers have divided dispersed clay particles in sandstones into three general types: (i) discrete particles, (ii) pore-lining clays and (iii) pore-bridging clays. Discrete particles are the typical form of occurrence for kaolinite in sandstone. Illite, chlorite, and smectite, however, can occur as both pore-lining and pore-bridging clays. The discrete particles have the lowest negative impact on permeability, while pore-bridging morphology leave the most severe permeability damage. The bridging morphology forms a partial-to-complete barrier to fluid flow. This can seriously impair rock permeability even in relatively high porosity sands and low clay content. It is contemplated that heating the rock and dynamic vibrational motion will granulate clay deposition during the ERS stimulation. The continuous process of a water stream will induce thermal stress, initiate micro fractures, and wash the particles out of the reservoir rock, increasing permeability of the sediment. It is further contemplated that the illustrative ERS system and method can be coupled with other methods, such as cold water thermal fracture propagation.

Figure 2:
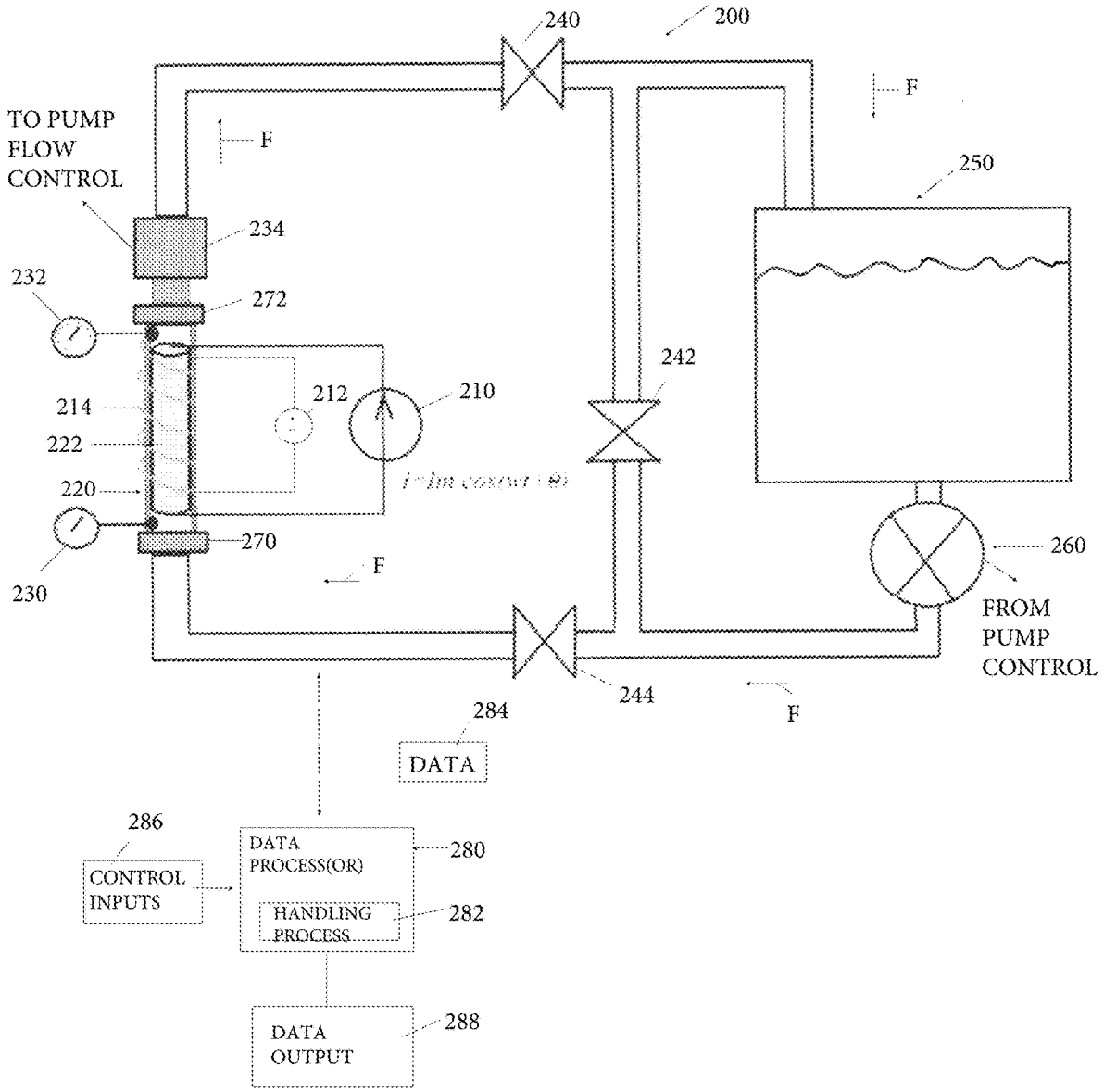
FIG. 2 is a diagram showing an exemplary test arrangement for determining and maximizing the efficacy of a low-frequency electrical treatment system on various core samples from candidate reservoirs.

FIG. 2 shows a generalized arrangement 200 for proof of concept/model of a system and method for increasing reservoir permeability via a Low-Frequency Electrical Treatment (LFET). The arrangement consists of an AC current power source 210 and voltage source 212, which powers a preheating coil 214 (e.g. a nichrome heating element) wrapped around a high-pressure-high-temperature (HPHT) cylindrical cell 220. The cell 220 contains a core sample 222, which corresponds to the reservoir rock/sedimentary material. The cell 220 includes a an inlet pressure gauge 230 and outlet pressure gauge 232, as well as a flow meter 234 at the outlet thereof. Flow of fluid (arrows F) is controlled by a series of valves 240, 242 and 244. The fluid circuit includes a fluid (water/brine) tank (acting as a fluid capacitor) 250 and associated pump 260.

The arrangement 200 is adapted to simulate the (HPHT) regime close to the reservoir conditions, and how the sample 222 will react to the LFET process applied thereto. High temperature is achieved by the preheater 214, and the high-pressure condition is reached by screw bolt system 270, 272 acting as a piston inside the cylindrical body of the cell. The two pressure gauges 230, 232 read the pressure data at the inlet and outlet stages. The flowmeter 234 provides feedback to control the flow rate at the pump 260. Several (e.g. K-type) thermocouples can be placed along the core sample 222 to read the temperature. All data generated by the sensors, pumps and other devices within the arrangement 200 can be interconnected with a data-acquisition and handling computer (and/or processor) 280 running an appropriate software program 282, such as LabView®, available from National Instruments Corporation of Austin, Tex., which is used for collecting and post-processing of the data 284. The computer/processor 280 receives user control inputs 286 to adjust the parameters of the arrangement via an appropriate user interface and the computer/processor outputs status, performance and result data (e.g. textual, numerical, graphical, etc.) 288 via the user interface.

Figure 3:
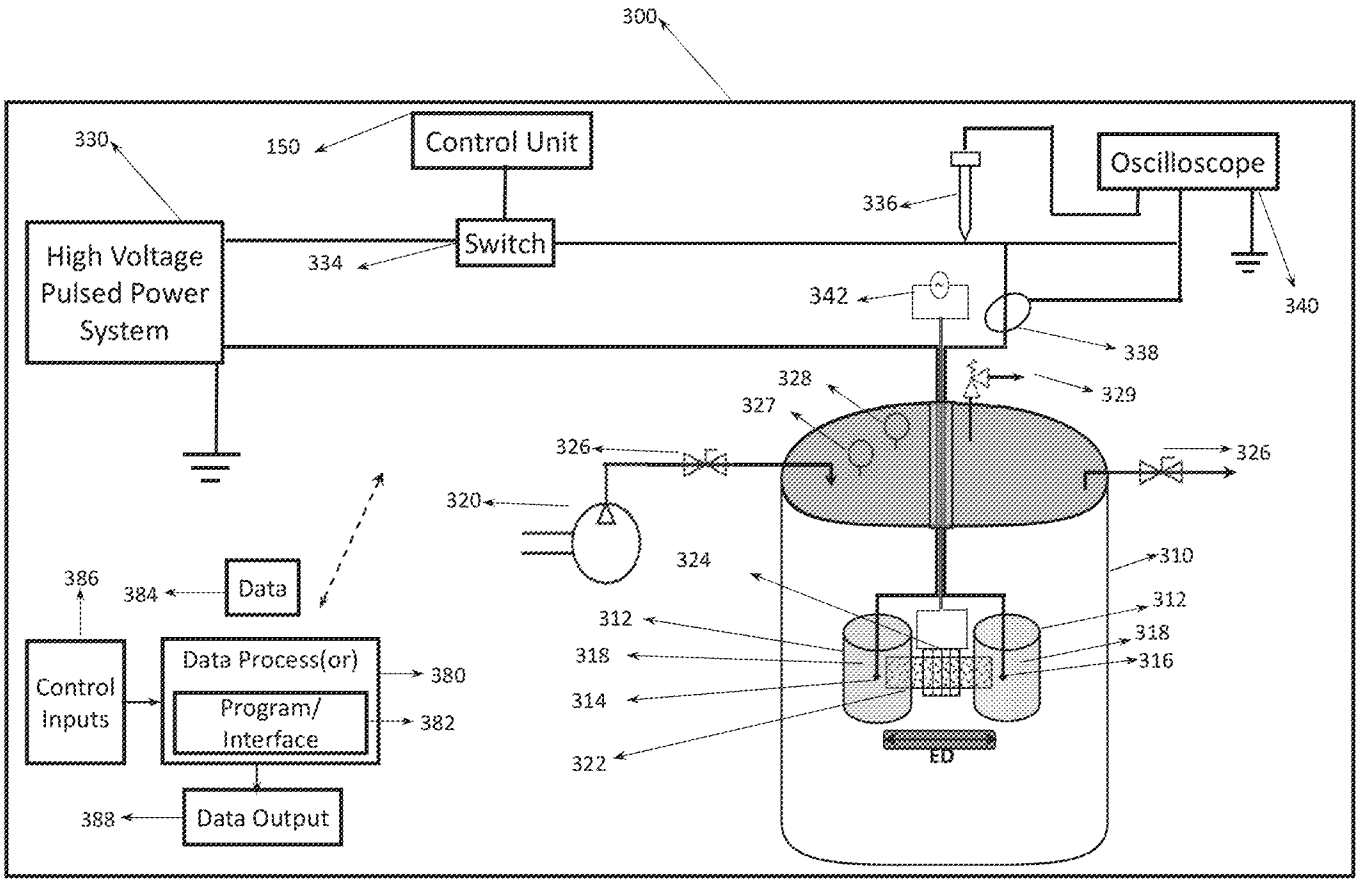
FIG. 3 is a schematic diagram of an exemplary lab scale experimental arrangement for determining and maximizing the efficacy of a pulsed electrical stimulation system on various core samples from candidate reservoirs.

FIG. 3 is a schematic diagram of an exemplary lab scale experimental arrangement for determining and maximizing the efficacy of the pulsed electrical stimulation of core samples 322, and a generalized arrangement 300 for proof of concept/model of a system and method for increasing reservoir permeability via pulsed ERS. The setup consists of High Voltage Pulsed Power System 330, a switch 334 and a controller 150 to configure voltage and pulse settings, an oscilloscope 340 connected to a voltage probe 336 and a current probe 338 to measure transient pulse voltage and current waveforms, and two electrodes 314, 316 extended into the pressure testing chamber 310. The two electrodes 314 and 316 can have an electrode distance ED between them of approximately 1 to 6 inches. Inside the pressure testing chamber 310, there are two thermally and electrically insulated ceramic containers 312 filled with saline brine or other geo-fluids 318. The two ceramic containers 312 hold the rock core sample 322 (which corresponds to the reservoir rock/sedimentary material) in between them through machined holes. The two ceramic containers 312 and the rock core sample 322 can have a sealing system around them. The temperature of the rock sample 322 is controlled by a temperature controller and DC power source. The testing chamber 310 is connected to a compressed air line 320 and its valves 326 to provide expected pressure. High pressure high temperature conditions (HPHT) increase accuracy of the experiment as it simulates reservoir conditions. The pressure chamber can have a temperature sensor 327 and a pressure sensor 328, and safety pressure relief valve 329. Temperature controller 342 powers a preheating coil 324 (e.g. a nichrome heating element) wrapped around core sample 322. The container 312 contains a core sample 322.

All data generated by the sensors, pumps and other devices within the setup and test cell can be interconnected with a data-acquisition and handling computer (and/or processor) 380 running an appropriate software program 382, such as LabView®, which is used for collecting and post-processing of the data 384. The computer/processor 380 receives user control inputs 386 to adjust the parameters of the arrangement via an appropriate user interface and the computer/processor outputs status, performance and result data (e.g. textual, numerical, graphical, etc.) 388 via the user interface.

Figure 4:
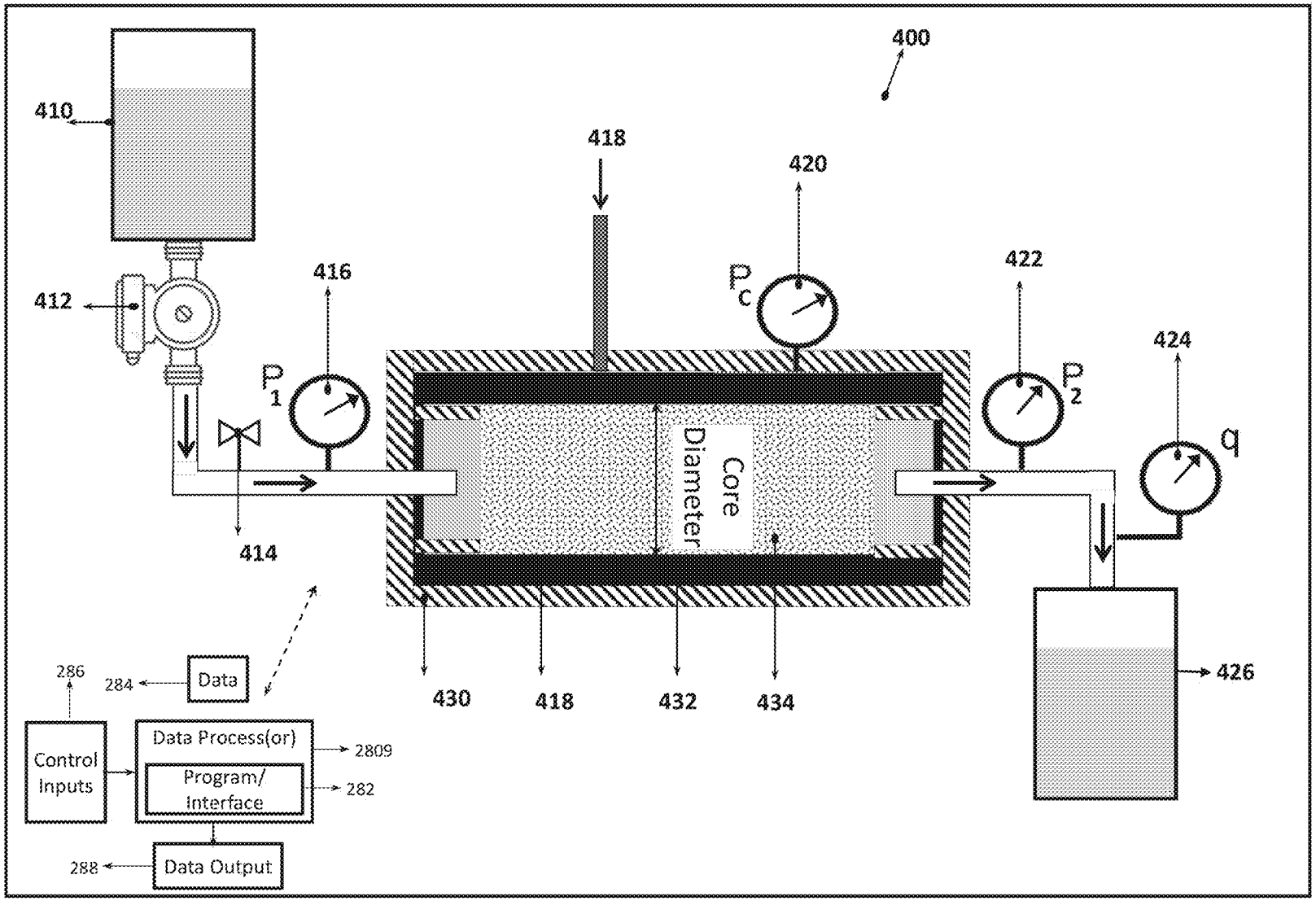
FIG. 4 is a schematic diagram of an apparatus for measuring permeability before and after applying high voltage pulsed discharge on rock sample in the experimental setup of FIG. 3.

FIG. 4 is a schematic diagram of an apparatus 400 for measuring permeability before and after running ERS on samples in the experimental setup of FIG. 3. It can include a supply tank 410 and a drained water tank 426, inline pump 412 and testing cell 430 between them, and inlet pressure gauge 416 and outlet pressure gauge 422, as well as a flow meter 424 at the outlet thereof. The cell 430 can include a pressurizing liquid pump 418 and a cell pressure gauge 420 to create and control higher pressures of pressurizing liquid 419 within the cell to provide pressure on the sample 322. A rubber sleeve 422 wrapped around the core sample 322 seals the side of the sample from the pressurizing liquid 419. The testing cell can accommodate different core sample lengths. Flow of fluid is controlled by pump 412 and a valve 414.

The experimental setup is adapted to simulate the (HPHT) regime close to the reservoir conditions, and how the sample 322 will react to the ERS process applied thereto. High temperature is achieved by the heater and temperature controller, and the high-pressure condition is reached by pump and pressurizing fluid pump 418. The two pressure gauges 416, 422 read the pressure data at the inlet and outlet stages. The flowmeter 424 provides feedback to control the flow rate at the pump 412. Several (e.g. K-type) thermocouples can be placed along the core sample 322 to read the temperature. All data generated by the sensors, pumps and other devices within the setup and test cell can be interconnected with the data-acquisition and handling computer (and/or processor) 380 running an appropriate software program 382, such as LabView®, which is used for collecting and post-processing of the data 384. The computer/processor 380 receives user control inputs 386 to adjust the parameters of the arrangement via an appropriate user interface and the computer/processor outputs status, performance and result data (e.g. textual, numerical, graphical, etc.) 388 via the user interface.

Figure 5:
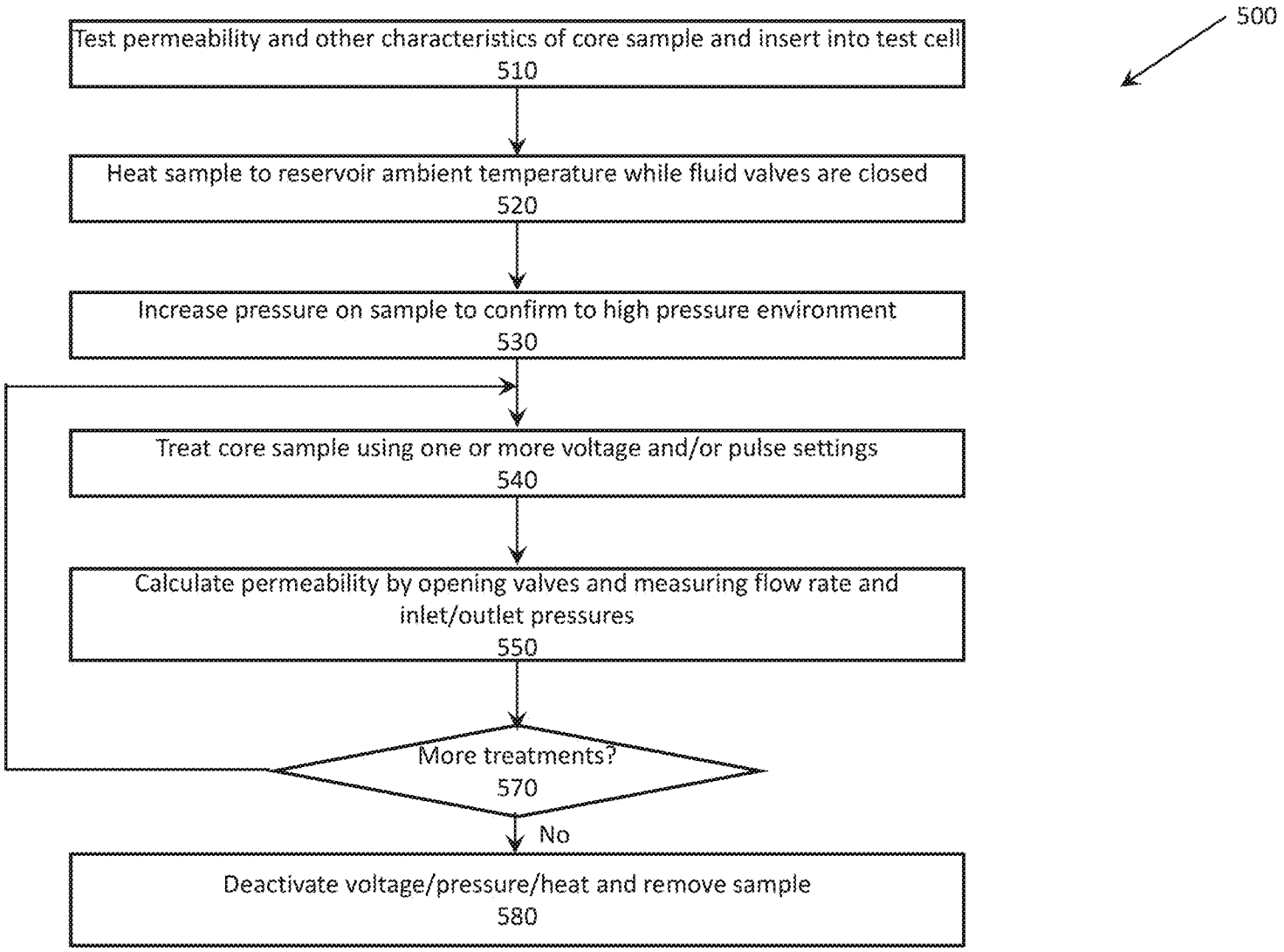
FIG. 5 is a flow diagram of an exemplary procedure for operating the arrangement of FIGS. 2-4, and otherwise performing an ERS procedure according to an embodiment.

With reference also to the flow diagram of FIG. 5, the procedure 500 for applying ERS to a core sample using the testing/modelling arrangement is described in further detail. Permeability enhancement due to the ERS stimulation on rock samples can be optimized by adjusting the parameters to find the maximum enhancement. Before initiating the procedure 500, optional preliminary tests on core samples will indicate their initial degree of permeability (step 510). At step 520, the sample in the cell can be pre-heated (e.g. 100-200° C.) while the fluid/water/brine flow valve(s) are closed. At step 530, the pressure inside the cell can be increased by pressurizing pump to mimic/conform to the reservoir pressure conditions. This procedure can measure permeability of a selected core sample from a formation in the testing cell under a specific elevated temperature and pressure condition, such as found in the reservoir. Elevated temperature and pressure will result in more accurate and closer to reservoir condition permeability values. After the initial permeability measurement, the next step 540 includes treating the core sample by applying pulsed power ERS stimulation in the pressure testing chamber under the elevated temperature and confined pressure with one specific set of voltage difference, energy, pulse width, and repetition rate, and/or applying low frequency electrical treatment with AC electric current at various voltages and frequencies (e.g. between 50 and 500 VAC and 1 and 100 kHz). The effect of the treatment on permeability of the sample can be observed. At step 550, the flow valve(s) can be opened for a predetermined time interval to allow fluid to enter and exit the core sample cell. Permeability of the stimulated core sample in the testing cell should be determined again and the change in the permeability before and after ERS should be calculated. The flow rate through the cell can be measured at the constant pressure difference, and permeability can be computed through the processor. The flow valve (s) can be closed at step 560. Depending on the permeability enhancement, other parameters or a combination of them can be modified to reach the maximum enhancement value for that specific core samples. If more treatment is specified (decision step 570), then the process loops to step 540 and the same or differing parameters can be applied via the processor and associated voltage source circuit. When the test is complete, valves are closed and pressure/power/heat are deactivated. The sample can be removed from the cell and inspected for its physical properties, post treatment (step 480).

In performing the test according to the procedure described above, there are at least two water/brine temperature cases. The first case is a cold temperature injection through the core sample immediately after the electrical treatment. This will mimic a thermal quenching procedure resulting from cold water injection through the well completion, and which may create fractures that can be analyzed after removing the core sample from the cell. The second temperature case is running water preheated to the reservoir temperature (using an appropriate heater). This would mimic somewhat natural ambient geo-fluid flow within the reservoir after the treatment.

A further test can entail determining the quantitative mineralogy of core samples using (e.g.) a point counting technique. There is a relationship between area percentages of various minerals in a section and their volume percentage in a rock. In a randomly chosen area of a rock, the ratio of the area of a particular mineral to the total area is an estimate of the volume percentage of that mineral in the rock. The Glagolev-Chayes method can be employed during such tests. In this method, the intersection of the cross-hairs of microscope is taken as the point. The mineral beneath it is identified, and one count is recorded for that particular mineral. Then, the thin section is moved a specific distance at the new point. The ratio of the counted points for a particular mineral to the total number of recorded points shows the volume percentage of that particular mineral.

The washed-out particles from the core sample can be counted as clay. These particles can be generated as a result of the treatment or inherent within the sample prior to treatment. The initial and final rock composition of the core samples will be determined and recorded by combining the results of the rock characterization tests. The porosity can be obtained from the fluid saturation porosity tests for each sample. Analysis of physicochemical and thermo-hydrodynamic processes occurring in continuous media at a condition of interaction with electro-magnetic and thermal fields can be performed—that is, an analysis of the micro-effects on the reservoir pores and rock particles from the electrical treatment. Rock alteration acceleration and cleaning pores from clay depositions can suggest a permeability increase. This task can entail use of pore-scale computer simulations, including (e.g.) the modeling software package, The Geochemist's Workbench®, available from Aqueous Solutions LLC via the World Wide Web. This software can model chemical reactions, trace reaction processes, model reactive transport, and plot the results of the calculations using different thermodynamic databases. Each database contains the properties of minerals, aqueous species, gases, equilibrium constants for reactions to form different species, and data required to calculate activity coefficients.

While the above arrangement and procedure relate to a test and analysis of the results of the illustrative ERS procedure described herein, it is expressly contemplated that various procedure steps can be used in conjunction with the actual process described in FIG. 1. That is, to determine the efficacy of the treatment, reservoir fluid flow rates or production can be tested before and after application of the procedure via the adjacent wells, and/core samples can be taken from the reservoir before and after treatment. The duration of treatment, in addition to the parameters for voltage, frequency, and pulse characteristics can be modified as permeability is analyzed.

Figure 6:
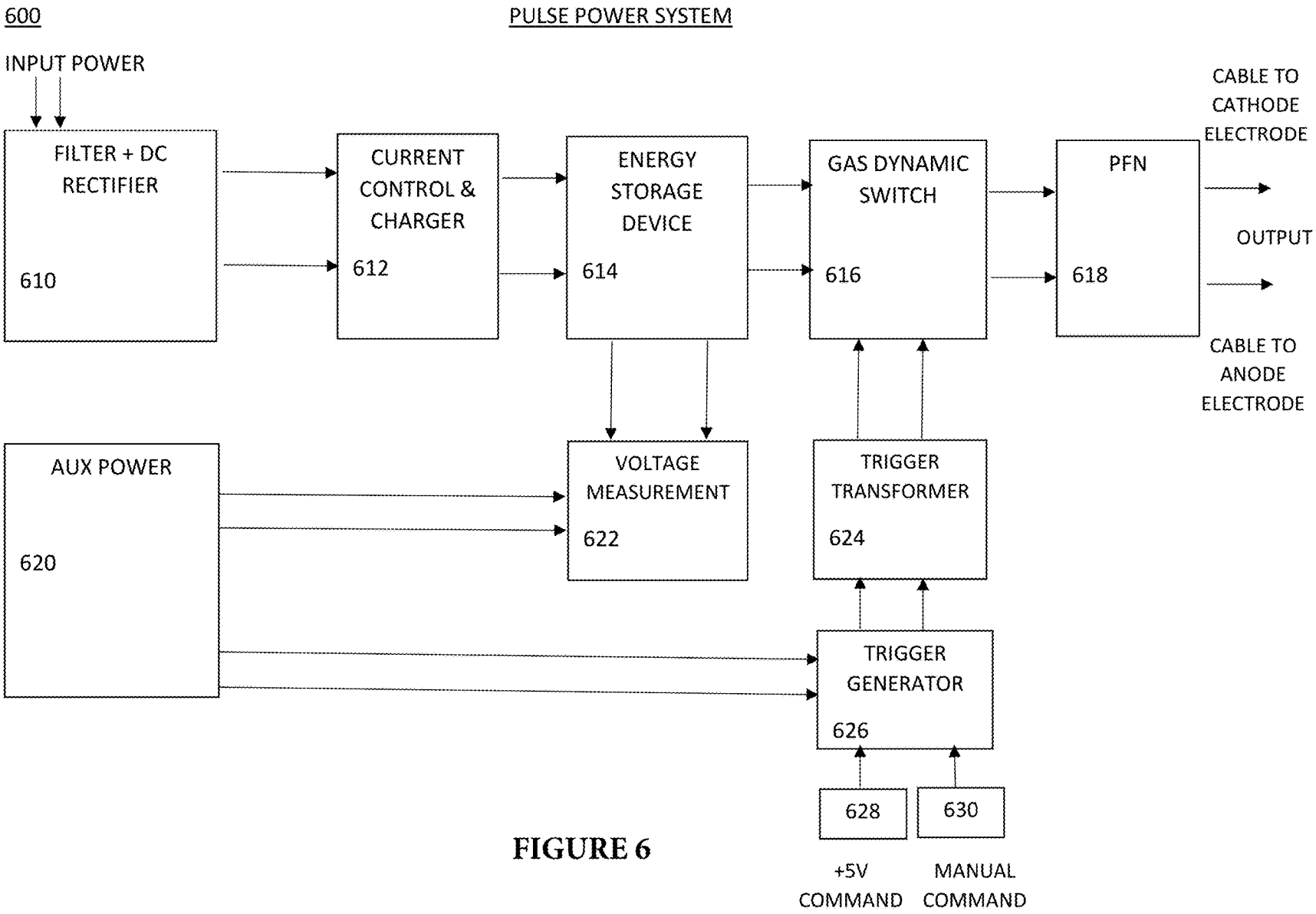
FIG. 6 is a schematic diagram of a pulsed power system, according to an illustrative embodiment.

FIG. 6 is a schematic diagram of a pulsed power system, according to an illustrative embodiment. The pulsed power system 600 which is shown in FIG. 6 is based on the principle of parallel charge and parallel discharge of very low inductance strip line capacitors through suitable spark gap systems which can handle peak currents and electrical stresses. It can have 110 V or 230 V or higher voltage alternating current as input power and consists of a filter and DC rectifier 610 to convert AC to DC, current control and charger to 612 store energy in energy storage devices 614 such as capacitor banks, gas dynamic switch 616 such as spark gap to discharge stored capacitor bank energy which can be adjusted for different voltage levels, pulsed forming network (PFN) 618 to form pulse shapes. The system can be started manually using manual command 630 or it can be attached with a +5 volts command 628 input to fire the generator. This can also be used to synchronize it with another scientific event which will have a +5 volts output pulse. Also, it is possible to fire the system using more voltage as well, if an attenuator is built. The trigger generator 626 will be able to be switched on and off. This generator should be switched on during operation which is connected to the switch by trigger transformer 624. Auxiliary power 620 feeds a real time voltage measurement system 622, trigger and command lines.

IV. Conclusion

It should be clear that the above-described system and method and associated modelling arrangement/procedure can provide many advantages over existing treatment methods for increasing permeability in well fields and the associated reservoirs accessed thereby. This system and method is relatively cost-effective and with none of the environmental issues of current methods. It is useful in both petroleum-producing wells and those used in geothermal power generation.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, as used herein, the terms "process" and/or "processor" should be taken broadly to include a variety of electronic hardware and/or software based functions and components (and can alternatively be termed functional "modules" or "elements"). Moreover, a depicted process or processor can be combined with other processes and/or processors or divided into various sub-processes or processors. Such sub-processes and/or sub-processors can be variously combined according to embodiments herein. Likewise, it is expressly contemplated that any function, process and/or processor herein can be implemented using electronic hardware, software consisting of a non-transitory computer-readable medium of program instructions, or a combination of hardware and software. Additionally, as used herein various directional and dispositional terms such as "vertical", "horizontal", "up", "down", "bottom", "top", "side", "front", "rear", "left", "right", and the like, are used only as relative conventions and not as absolute directions/dispositions with respect to a fixed coordinate space, such as the acting direction of gravity. Note also that the annulus can be non-circular in one or both border walls and can be broken by supports, packings or other spacers that maintain the shape of the overall coaxial arrangement. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances of the system (e.g. 1-5 percent). Accordingly, this description is meant to be taken only by way of example, and not to otherwise limit the scope of this invention.

What is claimed is:

1. A system for increasing permeability of a subsurface reservoir in the presence of at least two adjacent wells that extend into the reservoir comprising:

a controlled high voltage pulsed system interconnected to each of the at least two adjacent wells each electrically connected to the reservoir;

a controller that modulates at least one of the pulse widths, repetition rate and the voltage of the system; and a conductive fluid source that injects pressurized brine into at least one of the two adjacent wells so as to migrate into the reservoir in association with application of the discharged energy and to heat the reservoir, resulting in an increase in permeability and porosity.

2. The system as set forth in claim 1 wherein at least one of the pulsed power system and the conductive fluid source are each connected to a well head of the respective of the at least two wells.

3. The system as set forth in claim 2 wherein the pulsed power system is operatively connected so as to energize at least a portion of a casing of at least one of the two adjacent wells.

4. The system as set forth in claim 2 wherein at least one of the pulsed power system and the fluid source are carried to the reservoir within a completion of each of the at least two wells.

5. The system as set forth in claim 4 wherein the pulsed power system provided in an insulated cable that extends into the well and includes an exposed conductor adjacent to the region of the reservoir.

6. The system as set forth in claim 4 wherein the controller is operatively connected to a fluid flow sensor that determines changes in permeability at least, in part, based upon a change in flow of fluid from the fluid source.

7. The system as set forth in claim 1 wherein the controller is operated so that the pulse characteristics that is varied based upon at least one of the distances between the at least two wells.

8. The system as set forth in claim 7 wherein the pulse width is between approximately 10 microseconds and 10 seconds, and pulse repetition rate is approximately between 1 and 100 kHz.

9. The system as set forth in claim 8 wherein the controller is configured to adjust the pulse characteristics based upon a natural resonant frequency of rock in the reservoir.

10. The method as set forth in claim 1 wherein the pulse width and repetition rate are varied based upon at least one of the distance between the at least two wells.

11. The method as set forth in claim 10, further comprising, adjusting the pulse repetition rate to be between approximately between 1 and 100 kHz.

12. The method as set forth in claim 11 wherein the step of adjusting comprises setting the pulse characteristics based upon a natural resonant frequency of rock in the reservoir so as to, at least one of, (a) generate cracks and fractures in the rock and (b) dislodge sedimentary particles from the rock.

13. The method as set forth in claim 11 wherein the voltage is set so as to heat and transform the rock.

14. The system as set forth in claim 1, wherein the two adjacent wells are two adjacent production wells.

15. A method for increasing permeability of a subsurface reservoir in the presence of at least two adjacent wells that extend into the reservoir comprising the steps of:

interconnecting and operating a pulsed power system interconnected in each of the at least two adjacent wells so as to deliver the pulsed energy to the reservoir;

modulating, with a controller, at least one of the pulse width, repetition rate, and the voltage of the pulsed power system; and injecting a conductive fluid into at least one of the two adjacent wells so as to migrate into the reservoir in association with application of the pulsed energy and to heat the reservoir, resulting in an increase in permeability and porosity.

16. The method as set forth in claim 15, further comprising, based upon flow of the fluid, changes in permeability at least, in part, based upon a change in flow of fluid due to newly propagated fractures caused by the pulsed energy.

17. The method as set forth in claim 15 wherein the conductive fluid comprises a pressurized brine.

18. A system for increasing permeability of a subsurface reservoir in the presence of at least two adjacent wells that extend into the reservoir comprising:

a controlled high voltage pulsed system interconnected to each of the at least two adjacent production wells each electrically connected to the reservoir;

a controller that modulates at least one of the pulse widths, repetition rate and the voltage of the system; and a fluid source that injects fluid into at least one of the two adjacent production wells so as to migrate into the reservoir in association with application of the discharged energy, wherein the pulsed power system is operatively connected so as to energize at least a portion of a casing of at least one of the two adjacent production wells.

19. The system as set forth in claim 18, wherein the voltage is between approximately 50 kV and 500 kV.

* * * * *